US009781522B2

(12) United States Patent
Kulkarni

(10) Patent No.: US 9,781,522 B2
(45) Date of Patent: Oct. 3, 2017

(54) SYSTEMS AND METHODS FOR DETECTING DEGRADATION OF A MICROPHONE INCLUDED IN AN AUDITORY PROSTHESIS SYSTEM

(71) Applicant: ADVANCED BIONICS AG, Staefa (CH)

(72) Inventor: Abhijit Kulkarni, Newbury Park, CA (US)

(73) Assignee: Advanced Bionics AG, Staefa (CH)

( * ) Notice: Subject to any disclaimer, the term of this patent is extended or adjusted under 35 U.S.C. 154(b) by 0 days.

(21) Appl. No.: 14/907,270

(22) PCT Filed: Jul. 23, 2013

(86) PCT No.: PCT/US2013/051708
§ 371 (c)(1),
(2) Date: Jan. 22, 2016

(87) PCT Pub. No.: WO2015/012815
PCT Pub. Date: Jan. 29, 2015

(65) Prior Publication Data
US 2016/0165360 A1 Jun. 9, 2016

(51) Int. Cl.
*H04R 29/00* (2006.01)
*H04R 25/00* (2006.01)
*H04R 3/00* (2006.01)

(52) U.S. Cl.
CPC ..... *H04R 25/305* (2013.01); *H04R 3/005* (2013.01); *H04R 29/004* (2013.01); *H04R 29/008* (2013.01)

(58) Field of Classification Search
CPC ..... G10L 15/22; G10L 21/0232; G10L 25/78; G10L 15/02; H04R 3/04; H04R 1/22; H04R 2225/43; H04R 2460/13
(Continued)

(56) References Cited

U.S. PATENT DOCUMENTS 7,155,019 B2 12/2006 Hou
8,223,982 B2 7/2012 Ibrahim
(Continued)

OTHER PUBLICATIONS

International Search Report and Written Opinion received in International Application No. PCT/US13/051708, dated Apr. 2, 2014.

*Primary Examiner* — Alexander Jamal
(74) *Attorney, Agent, or Firm* — ALG Intellectual Property, LLC

(57) ABSTRACT

An exemplary system includes a sound processor associated with a patient, a first microphone communicatively coupled to the sound processor and configured to detect an audio signal presented to the patient and output a first output signal representative of the audio signal, and a second microphone communicatively coupled to the sound processor and configured to detect the audio signal presented to the patient and output a second output signal representative of the audio signal. The sound processor is configured to 1) receive the first and second output signals, 2) determine that a difference between the first and second output signals meets a threshold condition, and 3) perform, in response to the determination that the difference between the first and second output signals meets the threshold condition, a predetermined action associated with the quality level of the first microphone. Corresponding systems and methods are also disclosed.

20 Claims, 7 Drawing Sheets

(58) Field of Classification Search
USPC ..... 381/312, 320, 321, 94.2, 94.7, 101, 102, 381/103, 60
See application file for complete search history.

(56) References Cited

U.S. PATENT DOCUMENTS

| | | | | |
|---|---|---|---|---|
| 2004/0057593 | A1 | 3/2004 | Pedersen | |
| 2005/0259829 | A1* | 11/2005 | Van den Heuvel | H04R 25/30 381/60 |
| 2007/0175281 | A1 | 8/2007 | Klemenz et al. | |
| 2009/0296946 | A1 | 12/2009 | Zhang | |
| 2010/0189292 | A1 | 7/2010 | Wurzbacher et al. | |
| 2010/0260364 | A1* | 10/2010 | Merks | H04R 25/407 381/313 |
| 2010/0316226 | A1* | 12/2010 | Yoneda | H04R 3/002 381/59 |
| 2011/0274302 | A1 | 11/2011 | Isozaki | |
| 2013/0085549 | A1* | 4/2013 | Case | H04R 25/305 607/55 |
| 2014/0307903 | A1* | 10/2014 | Fichtl | H04R 25/552 381/315 |
| 2014/0363020 | A1* | 12/2014 | Endo | H04R 1/08 381/98 |

* cited by examiner

SYSTEMS AND METHODS FOR DETECTING DEGRADATION OF A MICROPHONE INCLUDED IN AN AUDITORY PROSTHESIS SYSTEM

BACKGROUND INFORMATION

Various types of auditory prosthesis systems have been developed to assist patients who have severe (e.g., complete) hearing loss. For example, cochlear implant systems may provide a sense of hearing for sensorineural hearing loss patients by providing electrical stimulation representative of sound directly to stimulation sites within the cochlea. As another example, electro-acoustic stimulation ("EAS") systems may assist patients with some degree of residual hearing in the low frequencies (e.g., below 1000 Hz) by providing acoustic stimulation representative of low frequency audio content and electrical stimulation representative of high frequency content.

Many auditory prosthesis systems include a sound processor apparatus (e.g., a behind-the-ear ("BTE") sound processing unit, a body worn device, etc.) configured to be located external to a patient. The sound processor apparatus may perform a variety of functions, such as processing audio signals presented to the patient, controlling an operation of one or more implantable devices (e.g., one or more cochlear implants), and providing power to the one or more implantable devices.

Audio signals presented to the patient are initially detected by a microphone located near the ear of the patient, such as mounted to an ear hook coupled to a housing that houses the sound processor. In order to properly detect sound, at least a portion of the microphone typically must be exposed to the environment. As a result, the microphone is exposed to many environmental contaminants such as skin, earwax, perspiration, and the like. The environmental contaminants and ordinary wear due to continued operation may cause the microphone to degrade. Degradation may manifest itself as a general decrease in sensitivity (e.g., drift) as well as a change in the frequency response of the microphone.

For small children especially, this degradation can be difficult to detect. Where the degradation affects the intelligibility of speech, the learning and language development of children can be affected. For patients in general, the degradation may occur slowly over time and therefore not be perceptible.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
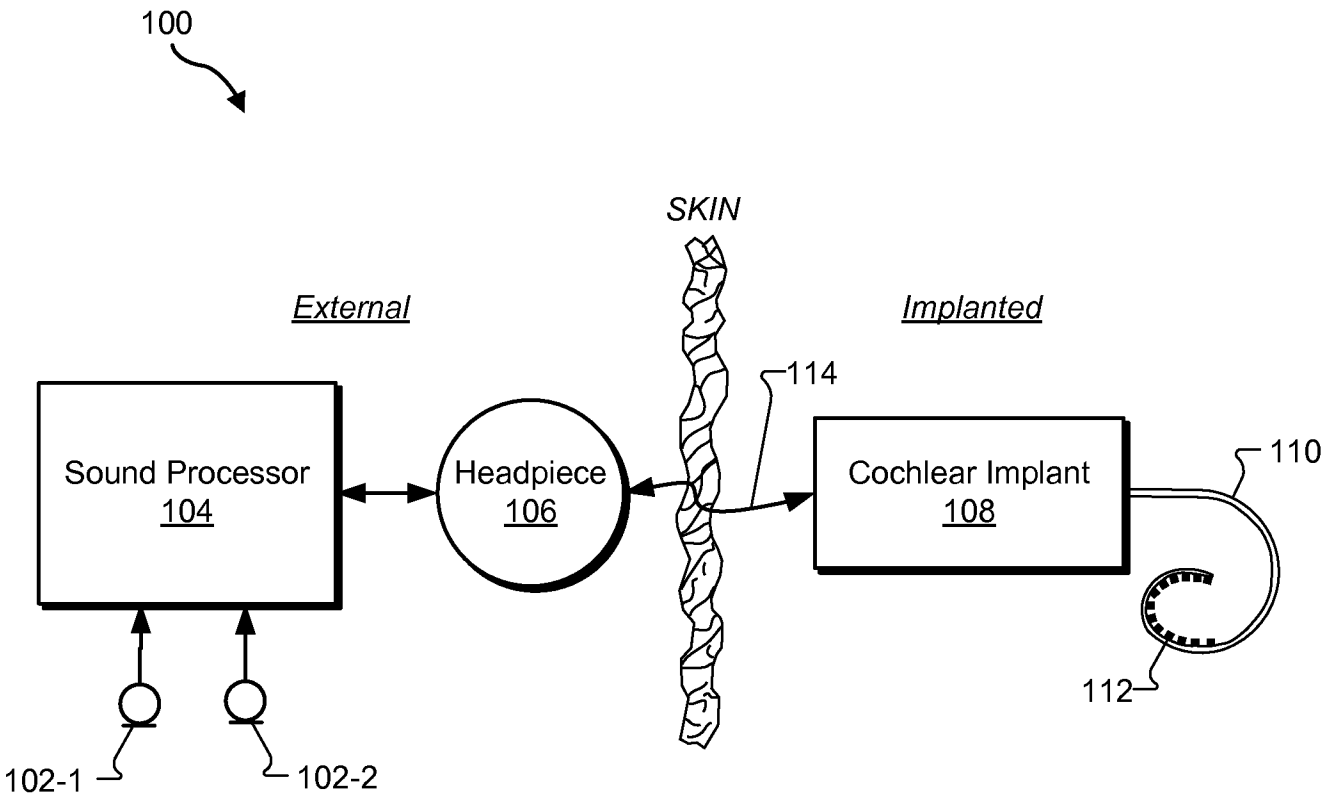
FIG. 1 illustrates an exemplary auditory prosthesis system according to principles described herein.

Systems and methods for detecting degradation of a microphone included in an auditory prosthesis system are described herein. An exemplary system includes a sound processor associated with a patient, a first microphone communicatively coupled to the sound processor and configured to detect an audio signal presented to the patient and output a first output signal representative of the audio signal, and a second microphone communicatively coupled to the sound processor and configured to detect the audio signal presented to the patient and output a second output signal representative of the audio signal. The sound processor is configured to receive the first and second output signals and determine whether a difference between the first and second output signals meets a threshold condition. As will be described below, a meeting of the threshold condition may indicate that a quality level of the first microphone is below an acceptable level. In response to a determination that the difference between the first and second output signals meets the threshold condition, the sound processor may perform a predetermined action associated with the quality level of the first microphone.

In one exemplary implementation, the predetermined action includes adjusting one or more control parameters that govern an operation of the auditory prosthesis system (i.e., the sound processor and/or a cochlear implant implanted within the patient). In another exemplary implementation, the predetermined action includes providing a notification that the quality level of the first microphone is below the acceptable level (e.g., by providing an alert by way of a light emitting device, a speaker, etc.).

To illustrate, it may be desirable to monitor a quality level of a microphone included in an auditory prosthesis system (e.g., a microphone, such as a "T-Mic", that is configured to be placed within the concha of the ear near the entrance to the ear canal). To this end, the sound processor may continuously monitor an output of the microphone relative to an output of a reference microphone (e.g., a system microphone disposed at least partially within a housing, such as a behind-the-ear unit, that houses the sound processor). If a difference between the output signals of the microphone and the reference microphone meets a predetermined threshold condition (e.g., if the difference between the output signals is outside a predetermined tolerance range of a reference signal maintained by the sound processor), the sound processor may determine that the quality level of the microphone is below an acceptable level (i.e., that the microphone has degraded in quality). In response to this determination, the sound processor may adjust one or more control parameters that govern an operation of the auditory prosthesis system (e.g., by increasing a gain applied to the output signals generated by the microphone), provide a notification that the quality level of the microphone is below the acceptable level (e.g., by providing an alert by way of a light emitting device, a speaker, etc.), and/or perform any other suitable predetermined action as may serve a particular implementation.

By continuously monitoring the output of a microphone relative to a reference microphone included in the same auditory prosthesis system, the systems and methods described herein may advantageously facilitate real-time evaluation of a quality level of the microphone, regardless of any variability in the audio signals detected by the microphones. This is because the difference in the outputs of the two microphones should always be relatively constant (i.e., consistently within a predetermined tolerance range of a reference signal maintained by the sound processor) if a quality level of both microphones is at or above an acceptable level.

FIG. 1 illustrates an exemplary auditory prosthesis system 100 that may be configured to detect and/or compensate for degradation of a microphone. Auditory prosthesis system 100 may include a primary microphone 102-1 (also referred to herein as a "first microphone"), a reference microphone 102-2 (also referred to herein as a "second microphone"), a sound processor 104, a headpiece 106 having a coil disposed therein, a cochlear implant 108, and a lead 110 with a plurality of electrodes 112 disposed thereon. Additional or alternative components may be included within auditory prosthesis system 100 as may serve a particular implementation.

As shown, auditory prosthesis system 100 may include various components configured to be located external to a patient including, but not limited to, primary microphone 102-1, reference microphone 102-2, sound processor 104, and headpiece 106. Auditory prosthesis system 100 may further include various components configured to be implanted within the patient including, but not limited to, cochlear implant 108 and lead 110.

Primary microphone 102-1 may be configured to detect audio signals presented to the patient and output output signals representative of the audio signals for processing by sound processor 104. Primary microphone 102-1 may be implemented in any suitable manner. For example, primary microphone 102-1 may include a "T-Mic" or the like that is configured to be placed within the concha of the ear near the entrance to the ear canal. Such a microphone may be held within the concha of the ear near the entrance of the ear canal by a boom or stalk that is attached to an ear hook configured to be selectively attached to sound processor 104 (i.e., to a housing that houses sound processor 104). Additionally or alternatively, primary microphone 102-1 may be implemented by a microphone disposed within headpiece 106, a microphone disposed within a housing that houses sound processor 104, and/or any other suitable microphone as may serve a particular implementation.

Reference microphone 102-2 may also be configured to detect the audio signals presented to the patient and output output signals representative of the audio signals for processing by sound processor 104. Reference microphone 102-2 may be implemented in any suitable manner. For example, reference microphone 102-2 may be implemented by any microphone included in auditory prosthesis system 100 other than primary microphone 102-1. To illustrate, if primary microphone 102-1 includes a "T-Mic" or the like that is configured to be placed within the concha of the ear near the entrance to the ear canal, reference microphone 102-2 may include a system microphone disposed at least partially within a housing that houses sound processor 104, a microphone disposed within headpiece 106, and/or any other microphone included in auditory prosthesis system 100 as may serve a particular implementation.

Reference microphone 102-2 may have some or all of the recording attributes of the primary microphone 102-1. In some examples, reference microphone 102-2 may only be used to evaluate performance of the primary microphone 102-1. Accordingly, reference microphone 102-2 may not be as sophisticated as primary microphone 102-1 in terms of sensitivity, frequency response, signal-to-noise ratio, or other metric of a microphone's ability to produce an output faithfully representing detected sound.

As will be described in more detail below, primary microphone 102-1 and reference microphone 102-2 may be positioned at different physical locations within auditory prosthesis system 100. Primary microphone 102-1 and reference microphone 102-2 may additionally or alternatively be oriented differently. Because of this, primary microphone 102-1 and reference microphone 102-2 may output different output signals (i.e., output signals having different characteristics) representative of the same audio signal presented to a patient associated with auditory prosthesis system 100. As will be described in more detail below, a difference between these output signals may be used to evaluate a quality level of primary microphone 102-1 (and, in some examples, a quality level of reference microphone 102-2).

Sound processor 104 (i.e., one or more components included within sound processor 104) may be configured to direct cochlear implant 108 to generate and apply electrical stimulation (also referred to herein as "stimulation current") representative of one or more audio signals (e.g., one or more audio signals detected by primary microphone 102-1, input by way of an auxiliary audio input port, etc.) to one or more stimulation sites associated with an auditory pathway (e.g., the auditory nerve) of the patient. Exemplary stimulation sites include, but are not limited to, one or more locations within the cochlea, the cochlear nucleus, the inferior colliculus, and/or any other nuclei in the auditory pathway. To this end, sound processor 104 may process the one or more audio signals in accordance with a selected sound processing strategy or program to generate appropriate stimulation parameters for controlling cochlear implant 108. Sound processor 104 may be housed within any suitable housing (e.g., a BTE unit, a body worn device, and/or any other sound processing unit as may serve a particular implementation).

In some examples, sound processor 104 may wirelessly transmit stimulation parameters (e.g., in the form of data words included in a forward telemetry sequence) and/or power signals to cochlear implant 108 by way of a wireless communication link 114 between headpiece 106 and cochlear implant 108. It will be understood that communication link 114 may include a bi-directional communication link and/or one or more dedicated uni-directional communication links.

As will be described in more detail below, sound processor 104 may determine (e.g., continuously monitor) a quality level of primary microphone 102-1. Sound processor 104 may perform any suitable predetermined action associated with the quality level of primary microphone 102-1 based on the determination. Exemplary predetermined actions that may be performed by sound processor 104 will be described in more detail below.

Headpiece 106 may be communicatively coupled to sound processor 104 and may include an external antenna (e.g., a coil and/or one or more wireless communication components) configured to facilitate selective wireless coupling of sound processor 104 to cochlear implant 108.

Headpiece 106 may additionally or alternatively be used to selectively and wirelessly couple any other external device to cochlear implant 108. To this end, headpiece 106 may be configured to be affixed to the patient's head and positioned such that the external antenna housed within headpiece 106 is communicatively coupled to a corresponding implantable antenna (which may also be implemented by a coil and/or one or more wireless communication components) included within or otherwise associated with cochlear implant 108. In this manner, stimulation parameters and/or power signals may be wirelessly transmitted between sound processor 104 and cochlear implant 108 via a communication link 114 (which may include a bi-directional communication link and/or one or more dedicated uni-directional communication links as may serve a particular implementation).

Cochlear implant 108 may include any type of implantable stimulator that may be used in association with the systems and methods described herein. For example, cochlear implant 108 may be implemented by an implantable cochlear stimulator. In some alternative implementations, cochlear implant 108 may include a brainstem implant and/or any other type of cochlear implant that may be implanted within a patient and configured to apply stimulation to one or more stimulation sites located along an auditory pathway of a patient.

In some examples, cochlear implant 108 may be configured to generate electrical stimulation representative of an audio signal processed by sound processor 104 (e.g., an audio signal detected by primary microphone 102-1) in accordance with one or more stimulation parameters transmitted thereto by sound processor 104. Cochlear implant 108 may be further configured to apply the electrical stimulation to one or more stimulation sites within the patient via one or more electrodes 112 disposed along lead 110. In some examples, cochlear implant 108 may include a plurality of independent current sources each associated with a channel defined by one or more of electrodes 112. In this manner, different stimulation current levels may be applied to multiple stimulation sites simultaneously by way of multiple electrodes 112.

The auditory prosthesis system 100 illustrated in FIG. 1 may be referred to as a cochlear implant system because sound processor 104 is configured to direct cochlear implant 108 to generate and apply electrical stimulation representative of audio content (e.g., one or more audio signals) to one or more stimulation sites within the patient by way of one or more of electrodes 112.

Figure 2:
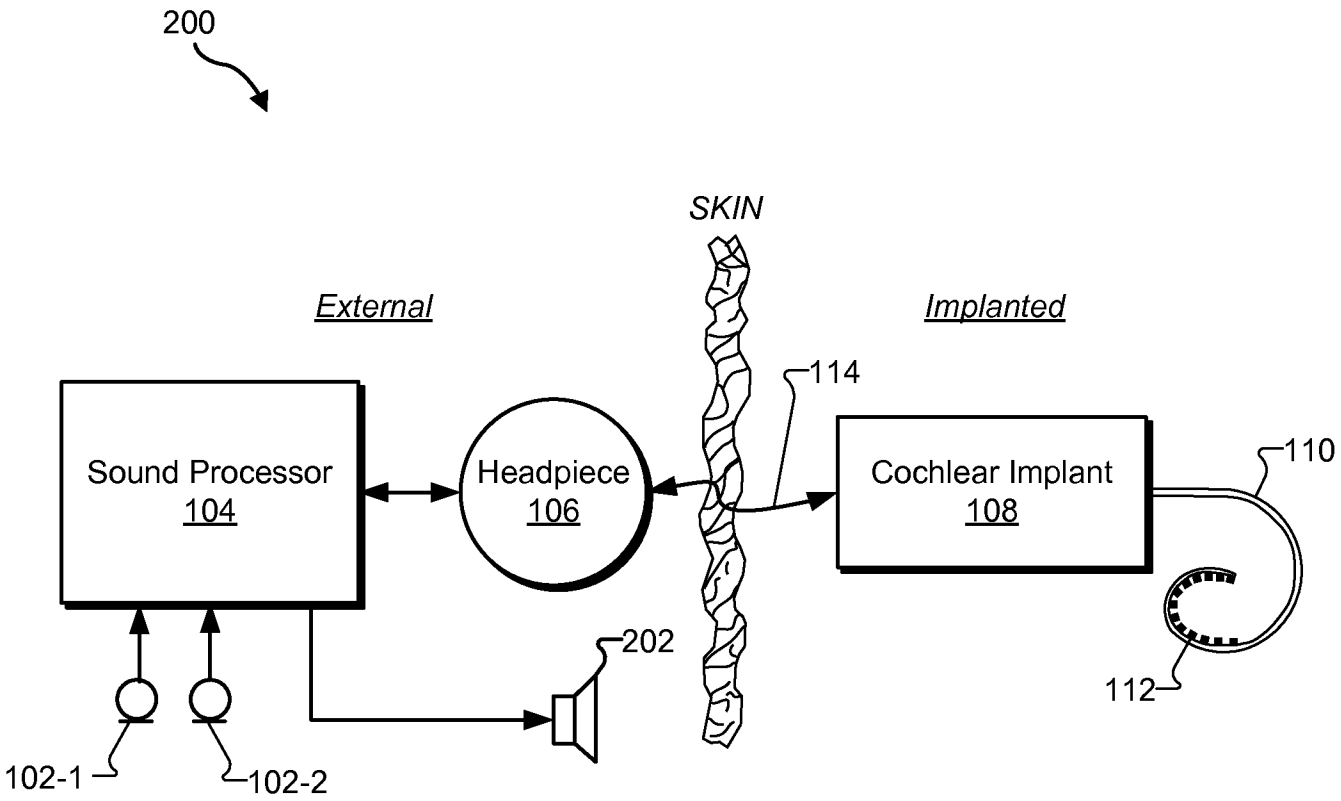
FIG. 2 illustrates an exemplary implementation of the auditory prosthesis system of FIG. 1 according to principles described herein.

FIG. 2 illustrates an exemplary implementation 200 of auditory prosthesis system 100 in which auditory prosthesis system 100 is further configured to provide acoustic stimulation to the patient. Hence, implementation 200 shown in FIG. 2 may be referred to as an electro-acoustic stimulation ("EAS") system.

As shown, implementation 200 may further include a receiver 202 (also referred to as a loudspeaker). In this configuration, sound processor 104 may be configured to direct receiver 202 to apply acoustic stimulation representative of audio content included in a relatively low frequency band (e.g., below 1000 Hz) to the patient and cochlear implant 108 to apply electrical stimulation representative of audio content included in a relatively high frequency band (e.g., above 1000 Hz) to one or more stimulation sites within the patient by way of one or more of electrodes 112.

Figure 3:
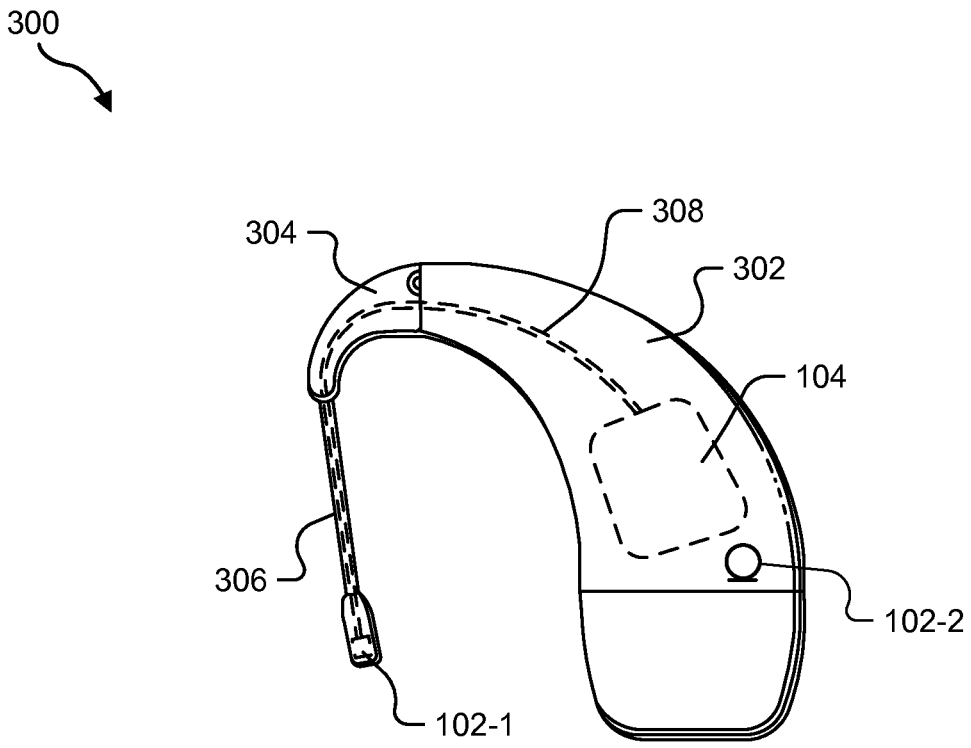
FIG. 3 illustrates another exemplary implementation of the auditory prosthesis system of FIG. 1 according to principles described herein.

As mentioned, primary microphone 102-1 and reference microphone 102-2 may be positioned at different physical locations within auditory prosthesis system 100. To illustrate, FIG. 3 shows an exemplary implementation 300 of the auditory prosthesis system 100 illustrated in FIG. 1. As shown, implementation 300 may include a housing 302 (e.g., a BTE housing) configured to be worn behind the ear of the patient and an ear hook assembly 304 configured to connect to housing 302.

In some examples, sound processor 104 is entirely disposed within housing 302 and reference microphone 102-2 is at least partially disposed within housing 302. In this configuration, reference microphone 102-2 may be relatively more protected from the outside environment than primary microphone 102-1, which, as described below, may be located near the opening of the ear canal.

As shown, primary microphone 102-1 may be coupled to ear hook assembly 304 by way of a stalk 306 (also referred to as a boom). Stalk 306 may be made from a bendable material that retains its bent position, thereby allowing the microphone assembly to be positioned, through selective bending of stalk 306, at a desired location near the opening of the ear canal. In this configuration, primary microphone 102-1 may be separate from housing 302 and therefore acoustically remote from reference microphone 102-2. In some examples, primary microphone 102-1 may be communicatively coupled to sound processor 104 by way of a communication link 308 (e.g., one or more wires).

As mentioned, sound processor 104 may determine a quality level of primary microphone 102-1. For example, primary microphone 102-1 and reference microphone 102-2 may each detect the same audio signal presented to an auditory prosthesis patient and output first and second output signals, respectively, that are representative of the audio signal. Sound processor 104 may receive the first and second output signals and determine whether a difference between the first and second output signals meets a threshold condition. If the difference meets the threshold condition, sound processor 104 may determine that the quality level of primary microphone 102-1 is below an acceptable level.

Figure 4:
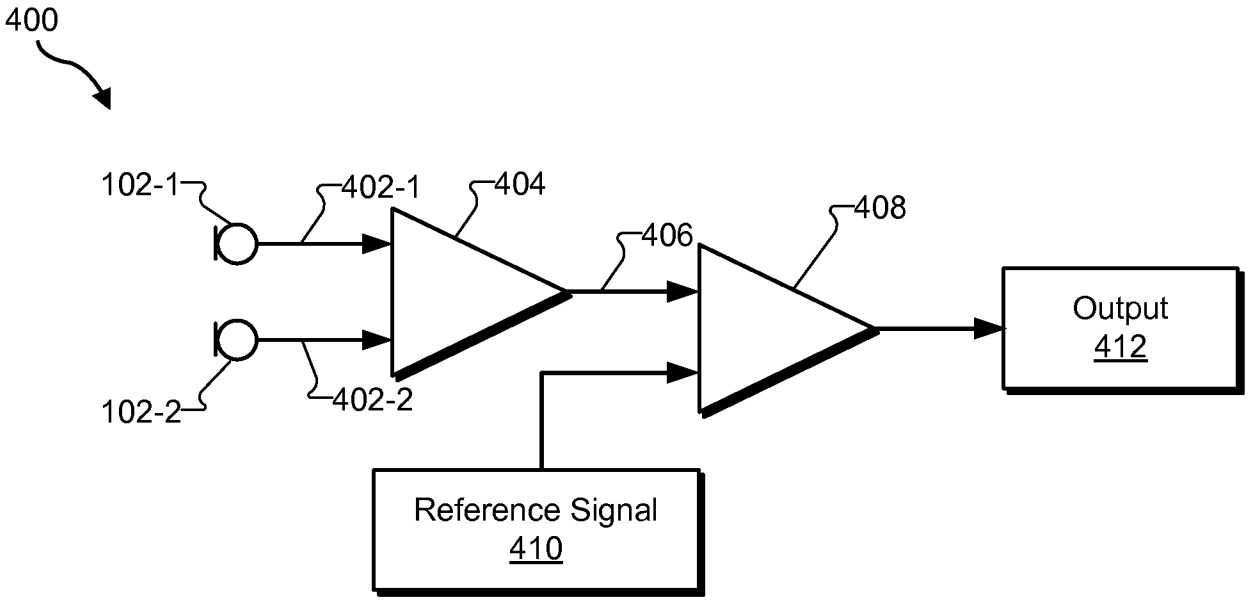
FIG. 4 illustrates an exemplary signal processing scheme that may be used by a sound processor according to principles described herein.

Sound processor 104 may determine that a difference between the first and second output signals meets a threshold condition in any suitable manner. For example, FIG. 4 illustrates an exemplary signal processing scheme 400 that may be used by sound processor 104 to determine whether a difference between first and second output signals provided by microphones 102-1 and 102-2, respectively, meets a threshold condition (i.e., whether a quality level of primary microphone 102-1 has degraded below an acceptable level). The illustrated components in FIG. 4 may be actual circuits included in sound processor 104 or representative of one or more software modules executed within sound processor 104.

As shown, primary microphone 102-1 and reference microphone 102-2 may each produce an output signal (represented by arrows 402-1 and 402-2, respectively) representative of the same audio signal presented to a cochlear implant patient. As described above, although the same audio signal is incident on both microphones 102-1 and 102-2, the output signals produced by primary microphone 102-1 and reference microphone 102-2 may be different due to the separation between them and differences in the materials through which the audio signal passes before reaching them.

Sound processor 104 may then use a comparator 404 to generate a difference signal (represented by arrow 406) representative of a difference between the first and second output signals. Comparator 404 may generate the difference signal in any suitable manner. For example, comparator 404 may subtract the second output signal from the first output signal in either the time domain or the frequency domain.

Sound processor 104 may then use a comparator 408 to compare the difference signal to a reference signal 410 maintained (e.g., stored) by sound processor 104. Reference signal 410 may be representative of a difference between output signals produced by primary microphone 102-1 and reference microphone 102-2 when a quality level of both primary microphone 102-1 and reference microphone 102-2 are known to at or above an acceptable level (e.g., at a time of manufacture).

Reference signal 410 may be generated and/or otherwise obtained in any suitable manner. For example, sound processor 104 (or any other processing device) may generate reference signal 410 by receiving a first reference output signal from primary microphone 102-1 and a second reference output signal from reference microphone 102-2 prior to receiving the first and second output signals (e.g., at a time of manufacture, at a time of calibration of auditory prosthesis system 100, and/or at any other suitable time) and generating a difference signal representative of a difference between the first and second reference output signals. The difference signal may then be used as reference signal 410.

Comparator 408 may compare the difference signal 406 output by comparator 404 to reference signal 410 in any suitable manner. For example, comparator 408 may generate an output 412 by subtracting reference signal 410 from difference signal 406 in either the time domain or the frequency domain. Output 412 may represent or characterize the difference between difference signal 406 and reference signal 410. For example, output 412 may be a difference signal, a single value (e.g., a correlation value) that characterizes the difference between difference signal 406 and reference signal 410, and/or any other type of output as may serve a particular implementation.

Sound processor 104 may determine, based on output 412, whether the difference between first and second output signals 402-1 and 402-2, respectively, meets a threshold condition that indicates that a quality level of primary microphone 102-1 is below an acceptable level. For example, sound processor 104 may determine that the difference between first and second output signals 402-1 and 402-2 meets the threshold condition if output 412 is outside a predetermined tolerance range of reference signal 410. In other words, if difference signal 406 differs more than a predetermined amount from reference signal 410, sound processor 104 may determine that the threshold condition is met (i.e., that the quality level of primary microphone 102-1 is below an acceptable level). Conversely, sound processor 104 may determine that the difference between first and second output signals 402-1 and 402-2 does not meet the threshold condition if output 412 is within the predetermined tolerance range of reference signal 410. In other words, if difference signal 406 does not differ more than a predetermined amount from reference signal 410, sound processor 104 may determine that the threshold condition is not met (i.e., that the quality level of primary microphone 102-1 is at or above the acceptable level).

Figure 5:
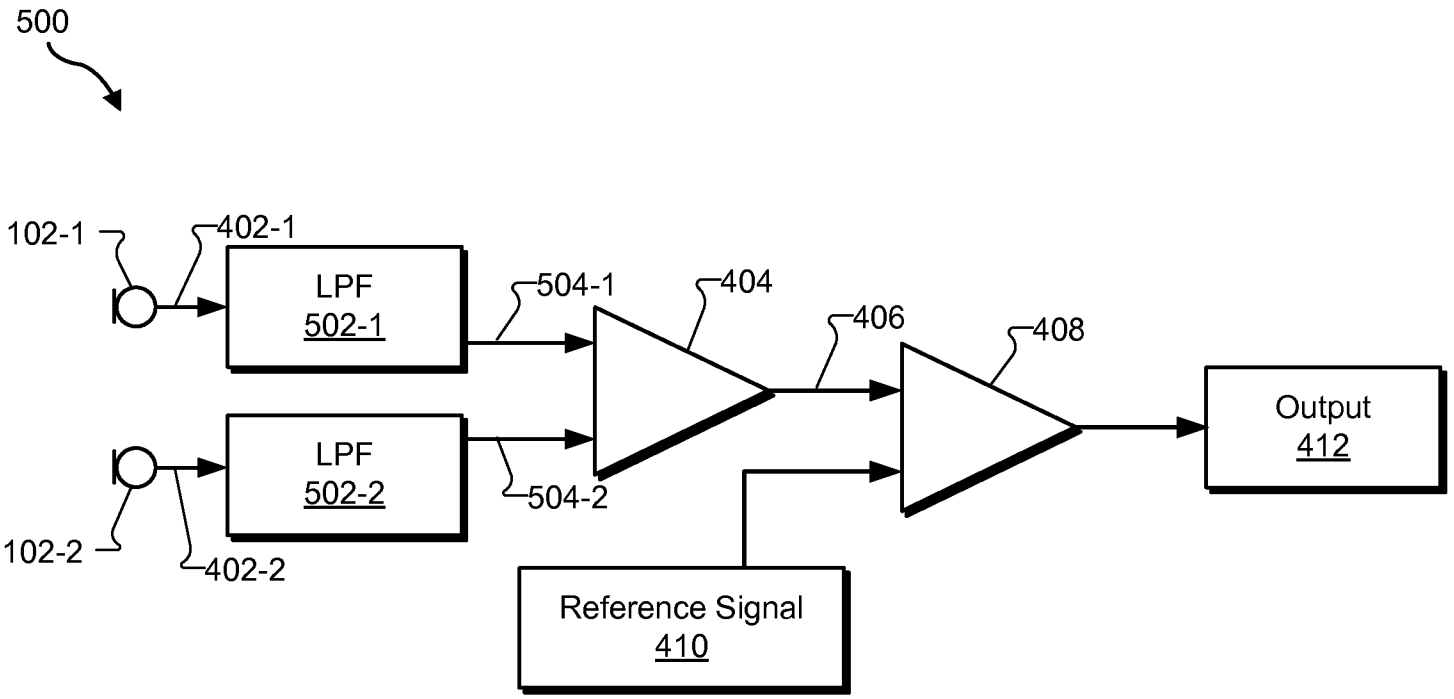
FIG. 5 illustrates another exemplary signal processing scheme that may be used by a sound processor according to principles described herein.

FIG. 5 illustrates another exemplary signal processing scheme 500 that may be used by sound processor 104 to determine whether a difference between first and second output signals provided by microphones 102-1 and 102-2, respectively, meets a threshold condition (i.e., whether a quality level of primary microphone 102-1 has degraded below an acceptable level). Signal processing scheme 500 is similar to signal processing scheme 400, except that signal processing scheme 500 low-pass filters the output signals produced by microphones 102-1 and 102-2.

To illustrate, FIG. 5 shows that the output signals 402-1 and 402-2 from microphones 102-1 and 102-2 are input into low-pass filters 502-1 and 502-2, respectively. The low-pass filters 502-1 and 502-2 may each have a cutoff frequency selected according to a separation distance between microphones 102-1 and 102-2. This is because the separation difference may cause the phase of the audio signal incident on each microphone 102-1 and 102-2 to be different. This phase difference increases with frequency. Accordingly, the cutoff frequency of the low-pass filters 502-1, 502-2 may be effective to remove higher frequency content in the outputs signals 402-1 and 402-2 of microphones 102-1 and 102-2, respectively, such that variation in the outputs due to phase differences is reduced. For example, low-pass filters 502-1 and 502-2 may have a cutoff frequency equal to $c/(X*d)$, where c is a speed of sound in air, d is a distance between microphones 102-1 and 102-2, and X is a value greater than three, such as a value greater than or equal to four. In some implementations, the value $c/(X*d)$ may be an initial estimate for a cutoff frequency that is subsequently tuned in order to obtain a cutoff frequency such that outputs of the low-pass filters 502-1, 502-2 may be reliably compared.

Low-pass filters 502-1 and 502-2 output first and second filtered portions (represented by arrows 504-1 and 504-2, respectively) of output signals 402-1 and 402-2. Sound processor 104 may then determine whether a difference between filtered portions 504-1 and 504-2 meets a threshold condition. This may be performed, for example, in a similar manner to that described above in connection with FIG. 4. In some examples, filtered portions 504-1 and 504-2 may be averaged over a time interval before being compared by sound processor 104.

Sound processor 104 may perform a variety of different predetermined actions in response to a determination that the difference between first and second output signals (e.g., output signals 402-1 and 402-2) output by primary microphone 102-1 and reference microphone 102-2 meet a threshold condition (i.e., in response to a determination that a quality level of primary microphone 102-1 is below an acceptable level).

For example, the predetermined action may include sound processor 104 adjusting one or more control parameters that govern an operation of auditory prosthesis 100 (e.g., sound processor 104 and/or cochlear implant 108). To illustrate, primary microphone 102-1 may decrease in sensitivity, thereby causing output 412 to increase accordingly. In response, sound processor 104 may increase a gain applied to the output of primary microphone 102-1 proportionally. As another example, a change in output 412 may indicate a change in the frequency response of primary microphone 102-1. In response, sound processor 104 may adjust the spectral profile of a processed version of the output of the primary microphone 102-1 based on output 412.

The predetermined action may additionally or alternatively include sound processor 104 providing a notification that the quality level of primary microphone 102-1 is below the acceptable level. In this manner, a user (e.g., the patient, a clinician, etc.) may be made aware of the degraded primary microphone 102-1 and take one or more actions to address the quality level of primary microphone 102-1 (e.g., by cleaning, replacing, adjusting, and/or otherwise doing something to primary microphone 102-1 to increase the quality level of primary microphone 102-1).

Figure 6:
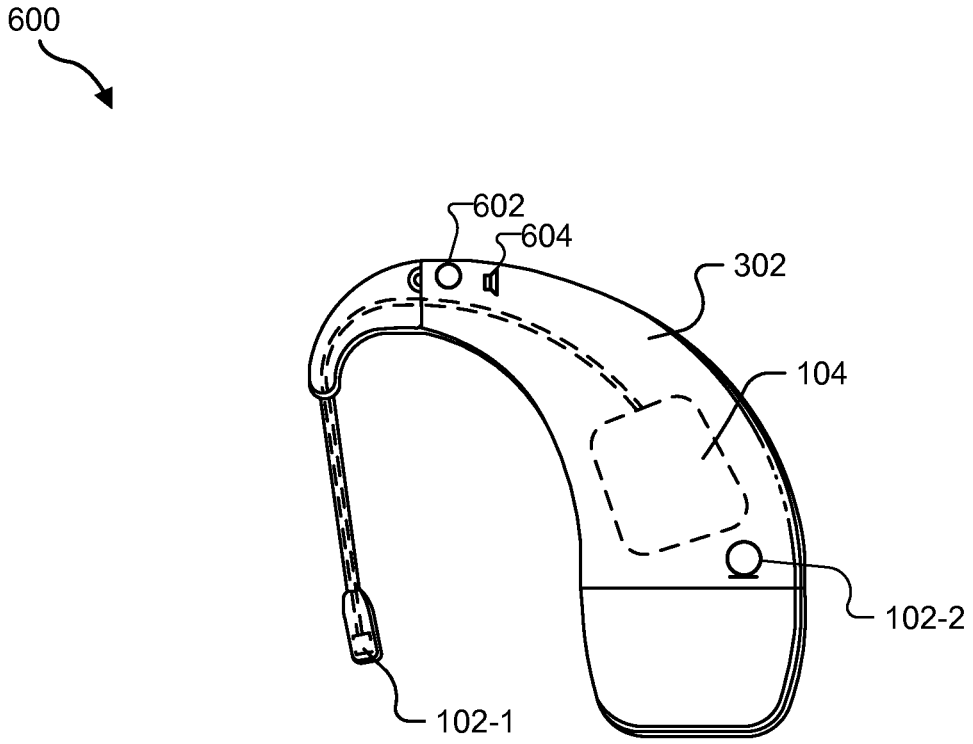
FIG. 6 illustrates another exemplary implementation of the auditory prosthesis system of FIG. 1 according to principles described herein.

Sound processor 104 may provide a notification that the quality level of primary microphone 102-1 is below the acceptable level in any suitable manner. For example, FIG. 6 illustrates an exemplary implementation 600 of auditory prosthesis system 100. Implementation 600 is similar to implementation 300, except that implementation 600 includes a light emitting diode ("LED") 602 and a speaker 604 integrated into housing 302. Both LED 602 and speaker 604 may be communicatively coupled to sound processor 104. It will be recognized that implementation 600 may alternatively not include LED 602 or speaker 604.

In some examples, sound processor 104 may provide the notification by way of LED 602 (or any other suitable light emitting device) and/or speaker 604. For example, sound processor 104 may provide the notification by activating LED 602 (e.g., by causing LED 602 to blink or remain illuminated).

Additionally or alternatively, sound processor 104 may provide the notification by activating speaker 604 (e.g., by causing speaker 604 to generate an audible alert). In some examples in which it is desirable to notify only the patient of the degradation in primary microphone 102-1, sound processor 104 may provide the notification by activating receiver 202 shown in FIG. 2.

In some examples, sound processor 104 may provide the notification by producing a diagnostic signal at a diagnostic interface (e.g., a fitting device, a computing device, or the like) communicatively coupled to sound processor 104. The diagnostic interface may then provide the notification (e.g., by way of a graphical user interface) based on the diagnostic signal.

Sound processor 104 may additionally or alternatively provide the notification by directing cochlear implant 108 to provide the notification to the patient. For example, sound processor 104 may direct cochlear implant 108 to excite one or more electrodes 112 in a manner that causes the patient to perceive a recognizable signal, such as a buzzing or beeping sound, voice message, or other signal.

It will be recognized that the light emitting devices, speakers, diagnostic interfaces, and cochlear implants are all illustrative of output devices that may be coupled to sound processor 104 and configured to generate a perceptible output indicating a degradation of primary microphone 102-1. Other output devices may additionally or alternatively be used to notify one or more users of the degradation of primary microphone 102-1 as may serve a particular implementation.

In some examples, different threshold conditions may be used to determine whether sound processor 104 adjusts one or more parameters governing an operation of auditory prosthesis system 100 or provides a notification indicative of a degradation in quality of primary microphone 102-1. For example, if a first threshold condition is met (e.g., if the difference between the output signals of primary microphone 102-1 and reference microphone 102-2 is outside a first predetermined tolerance range of a reference signal maintained by sound processor 104), sound processor 104 may adjust one or more parameters governing an operation of auditory prosthesis system 100. However, if the degradation of primary microphone 102-1 is more extensive (e.g., if a second more stringent threshold condition is met), sound processor 104 may provide the notification.

Figure 7:
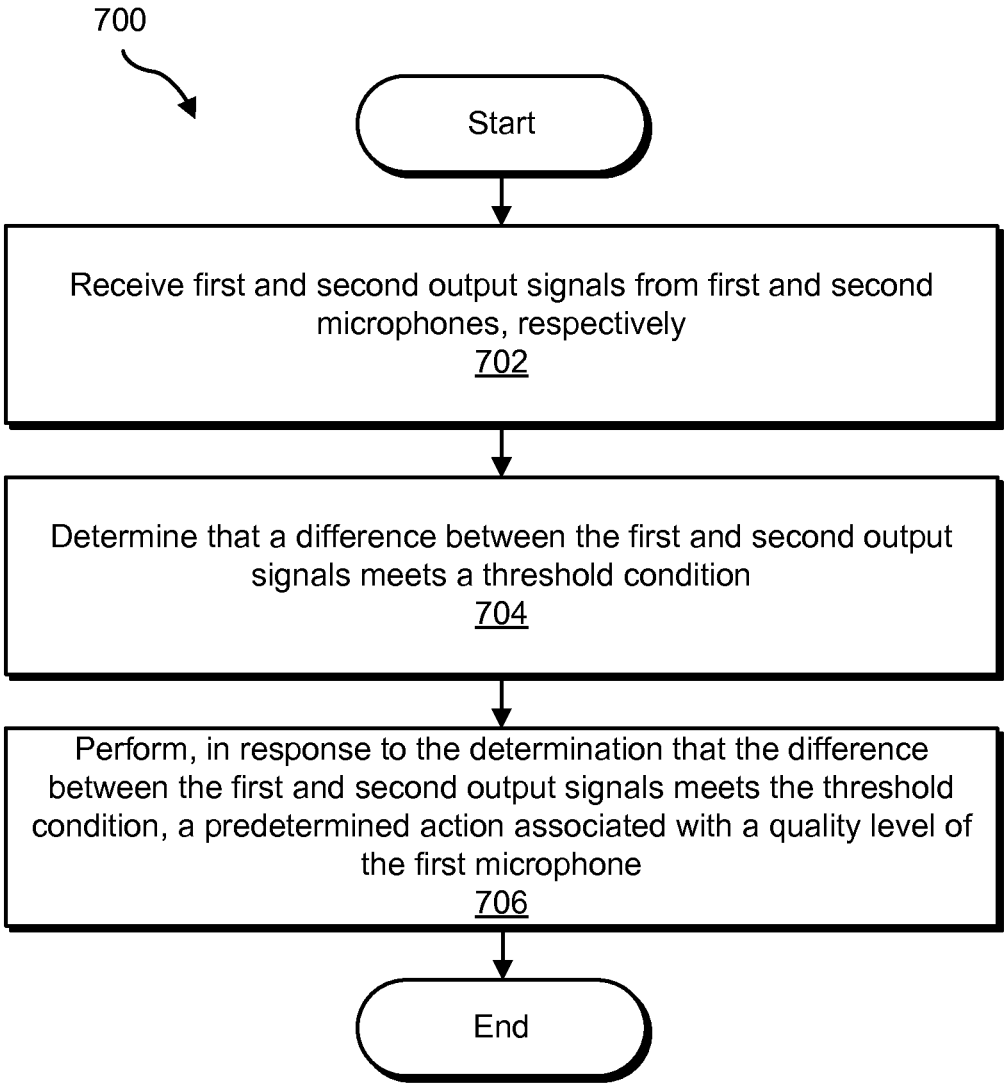
FIG. 7 illustrates an exemplary method of detecting degradation of a microphone included in an auditory prosthesis system according to principles described herein.

FIG. 7 illustrates an exemplary method of detecting degradation of a microphone included in an auditory prosthesis system. While FIG. 7 illustrates exemplary steps according to one exemplary implementation, other implementations may omit, add to, reorder, and/or modify any of the steps shown in FIG. 7. One or more of the steps shown in FIG. 7 may be performed by sound processor 104 and/or any implementation thereof.

In step 702, a sound processor receives a first output signal from a first microphone, such as primary microphone 102-1, and a second output signal from a second microphone, such as reference microphone 102-2. Step 702 may be performed in any of the ways described herein.

In step 704, the sound processor determines that a difference between the first and second output signals meets a threshold condition. As described above, a meeting of the threshold condition may indicate that a quality level of the first microphone is below an acceptable level. Step 704 may be performed in any of the ways described herein. For example, the sound processor may determine that a difference between the output signals is outside a predetermined tolerance range of a reference signal maintained by the sound processor.

In step 706, the sound processor performs, in response to the determination that the difference between the first and second output signals meets the threshold condition, a predetermined action associated with a quality level of the first microphone. Step 706 may be performed in any of the ways described herein. For example, the sound processor may adjust one or more parameters that govern the operation of the sound processor and/or provide a notification that the quality level of the first microphone is below an acceptable level.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

a sound processor associated with a patient;

a first microphone communicatively coupled to the sound processor and configured to detect an audio signal generated from a source external to the patient and output a first output signal representative of the audio signal;

a second microphone communicatively coupled to the sound processor and configured to detect the audio signal generated from a source external to the patient and output a second output signal representative of the audio signal;

wherein the sound processor is configured to receive the first and second output signals, determine that a difference between the first and second output signals meets a threshold condition by determining a distance between the first and second microphones, determining a cutoff frequency for a low-pass filter definition in accordance with c/(X*d), where c is a speed of sound in air, d is the determined distance between the first and second microphones, and X is a value greater than three, identifying a first filtered portion from the first output signal by low-pass filtering the first output signal according to the low-pass filter definition, identifying a second filtered portion from the second output signal by low-pass filtering the second output signal according to the low-pass filter definition, and determining that a difference between the first and second filtered portions meets the threshold condition, and perform, in response to the determination that the difference between the first and second output signals meets the threshold condition, a predetermined action associated with a quality level of the first microphone.

2. The system of claim 1, wherein the sound processor is configured to determine that the difference between the first and second filtered portions meets the threshold condition by:

averaging the first filtered portion to obtain a first averaged output signal;

averaging the second filtered portion to obtain a second averaged output signal;

generating a difference signal representative of a difference between the first and second averaged output signals; and determining that the difference signal is outside a predetermined tolerance range of a reference signal maintained by the sound processor.

3. The system of claim 1, wherein X is equal to 4.

4. The system of claim 2, wherein the sound processor is configured to generate the reference signal by:

receiving a first reference output signal from the first microphone prior to receiving the first and second output signals;

receiving a second reference output signal from the second microphone prior to receiving the first and second output signals;

generating a difference signal representative of a difference between the first and second reference output signals; and designating the difference signal representative of the difference between the first and second reference output signals as the reference signal.

5. The system of claim 1, wherein the sound processor is configured to perform the predetermined action associated with the quality level of the first microphone by adjusting one or more control parameters that govern an operation of at least one of the sound processor and a cochlear implant implanted within the patient.

6. The system of claim 1, wherein the sound processor is configured to perform the predetermined action associated with the quality level of the first microphone by providing a notification that the quality level of the first microphone is below the acceptable level.

7. The system of claim 6, wherein the sound processor is configured to provide the notification by activating a light-emitting device communicatively coupled to the sound processor.

8. The system of claim 6, wherein the sound processor is configured to provide the notification by activating a speaker communicatively coupled to the sound processor.

9. The system of claim 6, wherein the sound processor is configured to provide the notification by producing a diagnostic signal at a diagnostic interface communicatively coupled to the sound processor.

10. The system of claim 1, further comprising:

a housing configured to be wearable by a patient and configured to house the sound processor;

wherein the first microphone is separate from the housing, and the second microphone is at least partially disposed within the housing.

11. A system comprising:

a housing configured to be wearable by a patient;

a sound processor disposed within the housing;

a first microphone separate from the housing and communicatively coupled to the sound processor, the first microphone being configured to detect an audio signal generated from a source external to the patient and output a first output signal representative of the audio signal;

a second microphone at least partially disposed within the housing and communicatively coupled to the sound processor, the second microphone configured to detect the audio signal generated from the source external to the patient and output a second output signal representative of the audio signal; and an output device;

wherein the sound processor is configured to receive the first and second output signals, determine that a difference between the first and second output signals meets a threshold condition by determining a distance between the first and second microphones, determining a cutoff frequency for a low-pass filter definition in accordance with c/(X*d), where c is a speed of sound in air, d is the determined distance between the first and second microphones, and X is a value greater than three, identifying a first filtered portion from the first output signal by low-pass filtering the first output signal according to the low-pass filter definition, identifying a second filtered portion from the second output signal by low-pass filtering the second output signal according to the low-pass filter definition, and determining that a difference between the first and second filtered portions meets the threshold condition, and direct, in response to the determination that the difference between the first and second output signals meets the threshold condition, the output device to generate a perceptible output indicating a degradation of the first microphone.

12. The system of claim 11, further comprising an ear hook assembly configured to connect to the housing, wherein the first microphone is coupled to the ear hook assembly.

13. The system of claim 11, wherein the output device comprises one or more of a light-emitting device and a speaker.

14. The system of claim 11, wherein the output device comprises a diagnostic interface.

15. A method comprising:

receiving, by a sound processor associated with a patient, a first output signal from a first microphone, the first output signal representative of an audio signal generated from a source external to the patient and detected by the first microphone;

receiving, by the sound processor, a second output signal from a second microphone, the second output signal representative of the audio signal generated from the source external to the patient and detected by the second microphone;

determining, by the sound processor, that a difference between the first and second output signals meets a threshold condition by determining a distance between the first and second microphones, determining a cutoff frequency for a low-pass filter definition in accordance with c/(X*d), where c is a speed of sound in air, d is the determined distance between the first and second microphones, and X is a value greater than three, identifying a first filtered portion from the first output signal by low-pass filtering the first output signal according to the low-pass filter definition, identifying a second filtered portion from the second output signal by low-pass filtering the second output signal according to the low-pass filter definition, and determining that a difference between the first and second filtered portions meets the threshold condition; and performing, by the sound processor in response to the determination that the difference between the first and second output signals meets the threshold condition, a predetermined action associated with a quality level of the first microphone.

16. The method of claim 15, wherein the determining that the difference between the first and second filtered portions meets the threshold condition comprises:

averaging the first filtered portion to obtain a first averaged output signal;

averaging the second filtered portion to obtain a second averaged output signal;

generating a difference signal representative of a difference between the first and second averaged output signals; and determining that the difference signal is outside a predetermined tolerance range of a reference signal maintained by the sound processor.

17. The method of claim 16, further comprising generating, by the sound processor, the reference signal by:

receiving a first reference output signal from the first microphone prior to receiving the first and second output signals;

receiving a second reference output signal from the second microphone prior to receiving the first and second output signals;

generating a difference signal representative of a difference between the first and second reference output signals; and designating the difference signal representative of the difference between the first and second reference output signals as the reference signal.

18. The method of claim 15, wherein the performing of the predetermined action associated with the quality level of the first microphone comprises adjusting one or more control parameters that govern an operation of at least one of the sound processor and a cochlear implant implanted within the patient.

19. The method of claim 15, wherein the performing of the predetermined action associated with the quality level of the first microphone comprises providing a notification that the quality level of the first microphone is below the acceptable level.

20. The method of claim 19, wherein the providing of the notification comprises activating a light-emitting device communicatively coupled to the sound processor.

* * * * *